US010307030B2

(12) United States Patent
Schultink et al.

(10) Patent No.: US 10,307,030 B2
(45) Date of Patent: Jun. 4, 2019

(54) HOLDING PLATE FOR A VACUUM CLEANER FILTER BAG

(75) Inventors: Jan Schultink, Overpelt (BE); Ralf Sauer, Overpelt (BE)

(73) Assignee: Eurofilters Holding N.V., Overpelt (BE)

( * ) Notice: Subject to any disclaimer, the term of this patent is extended or adjusted under 35 U.S.C. 154(b) by 768 days.

(21) Appl. No.: 13/501,400

(22) PCT Filed: Sep. 21, 2010

(86) PCT No.: PCT/EP2010/005777

§ 371 (c)(1),
(2), (4) Date: May 14, 2012

(87) PCT Pub. No.: WO2011/047763

PCT Pub. Date: Apr. 28, 2011

(65) Prior Publication Data

US 2012/0216494 A1 Aug. 30, 2012

(30) Foreign Application Priority Data

Oct. 19, 2009 (EP) ..... 09013166

(51) Int. Cl.
*A47L 9/14* (2006.01)
*B01D 46/02* (2006.01)

(52) U.S. Cl.
CPC ..... *A47L 9/1445* (2013.01)

(58) Field of Classification Search
CPC ..... A47L 9/14; A47L 9/1427; A47L 9/1436; A47L 9/149; B01D 46/02
USPC ..... 55/367, 368, 335, 361, 320, 374, 337, 55/381, DIG. 2, DIG. 3; 15/353, DIG. 8; 95/273; 264/DIG. 48; 156/163, 164
See application file for complete search history.

(56) References Cited

U.S. PATENT DOCUMENTS 6,379,409 B1 * 4/2002 Dijkman ..... 55/381
2007/0292858 A1 * 12/2007 Chen et al. ..... 435/6

FOREIGN PATENT DOCUMENTS

| | | | |
|---|---|---|---|
| DE | 2116579 | A1 | 10/1972 |
| DE | 202004008971 | U1 | 8/2004 |
| DE | 102005041811 | A1 | 3/2007 |
| DE | 102005027078 | | 4/2007 |
| DE | 102006029059 | | 12/2007 |
| DE | 10203436 | | 8/2008 |
| DE | 102007000057 | | 8/2008 |
| DE | 102007040417 | A1 | 3/2009 |

(Continued)

OTHER PUBLICATIONS

International Search Report completed Nov. 25, 2010 for International Application No. PCT/EP2010/005777.

*Primary Examiner* — Amber R Orlando
*Assistant Examiner* — Minh Chau T Pham
(74) *Attorney, Agent, or Firm* — Brinks Gilson & Lione

(57) ABSTRACT

The invention relates to a holding plate for a vacuum cleaner filter bag having a bag wall, the holding plate including a base plate made of a first plastic material with a passage opening, and a connecting element that is connected to the base plate by a material bond and is made of a second plastic material, for connecting the base plate to the bag wall by a material bond, in particular by means of ultrasonic welding, characterized in that the connecting element is arranged on the side of the base plate that is to be connected to the bag wall.

17 Claims, 2 Drawing Sheets

(56) References Cited

FOREIGN PATENT DOCUMENTS

| | | | |
|---|---|---|---|
| DE | 20 2008 004 025 | U1 | 9/2009 |
| EP | 0960645 | | 1/1999 |
| EP | 2011556 | | 1/2009 |
| WO | WO 03079878 | A1 | 10/2003 |
| WO | WO 2011/047763 | A1 | 4/2011 |

* cited by examiner

HOLDING PLATE FOR A VACUUM CLEANER FILTER BAG

This application claims the benefit under 35 U.S.C. § 371 of International Application No. PCT/EP2010/005777, filed Sep. 21, 2010, which claims the benefit of European Patent Application No. 09013166.5, filed Oct. 19, 2009, which are incorporated by reference herein in their entirety.

FIELD OF THE INVENTION

The invention relates to a holding plate for a vacuum cleaner filter bag with a bag wall.

BACKGROUND

In vacuum cleaners, vacuum cleaner filter bags are often used for filtering the sucked-in air. These vacuum cleaner filter bags comprise a bag wall of a filter material which filters out the dust and dirt particles contained in the sucked-in air, and a holding plate fixed at the bag wall to position the vacuum cleaner filter bag in the vacuum cleaner. At the apparatus, a mounting with which the holding plate can be engaged is often associated to the holding plate in the vacuum cleaner, whereby in turn the positioning of the vacuum cleaner filter bag in the vacuum cleaner is achieved. Via a connecting piece, the air to be filtered is usually directed into the interior of the filter bag through a passage opening in the holding plate and in the bag wall.

As a material for the holding plate, plastic is often used. Moreover, holding plates are known which consist of two different plastics and are manufactured in a two-component injection molding process. For example, DE 10 2007 040 417 describes a plastic holding plate with a closure flap, where the opening periphery is made of a softer plastic than the holding plate itself. Closure flaps are often used to close the passage opening in the bag wall and the holding plate when the vacuum cleaner is not in operation.

From DE 02 005 041 811, a holding plate with an elastomer seal injected to it is known. Such sealing lips are usually provided in the region of the passage opening of the holding plate and are to prevent dust from leaking from the vacuum cleaner filter bag by sealing the region between the inner periphery of the passage opening and the outer surface of a connecting piece of the vacuum cleaner. Such sealing lips are also known from DE 21 16 579, DE 10 2006 029059, or DE 10 2005 027 078. From DE 10 2007 057 171, a plastic seal with radially extending reinforcements is moreover known.

The holding plate is often connected with the bag wall of the vacuum cleaner filter bag by a material bond by means of ultrasonic welding. From DE 102 03 436, for example, a holding plate of cardboard is known which is coated with plastic permitting the welding of the holding plate to the bag wall. DE 20 2004 008 971 describes an ultrasonic welding connection between a plastic holding plate and a bag wall which at least partially consists of a thermoplastic filter material, wherein between the holding plate and the bag wall, a seal membrane of plastic material is moreover arranged. A similar solution with a rubbery-elastic layer is known from DE 10 2007 062 028. In both cases, the connection of the holding plate with the bag wall is complicated by the additional seal membrane or rubbery-elastic layer, respectively.

The connection of known holding plates with a sealing lip injected to them with the bag wall by means of ultrasonic welding often turns out to be problematic as the introduced ultrasonic energy can lead to damages of the holding plate, for example the sealing lip. To avoid this, the introduced energy is minimized, which, however, involves the disadvantage that the connection thus formed between the holding plate and the bag wall can be relatively easily released. In other words, the holding plate can be separated again from the bag wall after welding with a relatively low expenditure of force. In particular when the full vacuum cleaner filter bag is removed from the vacuum cleaner, there thus is a risk in that the connection between the holding plate and the bag wall is unintentionally released and thus dust escapes from the vacuum cleaner filter bag.

BRIEF SUMMARY

It is therefore the object of the present invention to provide a holding plate for a vacuum cleaner filter bag with a bag wall which permits a stronger connection with the bag wall in a simple manner.

The invention provides a holding plate for a vacuum cleaner filter bag with a bag wall, the holding plate comprising a base plate of a first plastic material, wherein the base plate comprises a passage opening, and a connecting element of a second plastic material connected to the base plate by a material bond for connecting the base plate with the bag wall by a material bond, in particular by means of ultrasonic welding, wherein the connecting element is arranged on the side of the base plate to be connected to the bag wall.

Such a holding plate permits to select the second plastic material such that the base plate can be advantageously connected to the bag wall. In particular, the parameters of the second plastic material can be selected such that the base plate can be firmly connected to the bag wall by means of ultrasonic welding, even if only a relatively low ultrasonic energy is introduced and the welding period is thus very short. By this, a stronger connection between the holding plate and the bag wall of the vacuum cleaner filter bag can be established.

The bag wall of the vacuum cleaner filter bag can comprise one or several filter material layers, in particular one or several non-woven layers. Vacuum cleaner filter bags with such a bag wall of several filter material layers are known, for example, from EP 2 011 556 or EP 0 960 645. As a material for the non-woven layers, very diverse plastics can be used, for example polypropylene and/or polyester. In particular the layer of the bag wall to be connected to the holding plate can be a non-woven layer.

The bag wall can have a passage opening, wherein the passage opening of the bag wall is in particular arranged to be aligned with the passage opening of the base plate. By the passage opening in the base plate and the passage opening in the bag wall, an admission port can be formed through which the air to be cleaned can flow into the interior of the vacuum cleaner filter bag.

The first plastic material can in particular be different from the second plastic material. As a first and/or second plastic material, basically very diverse plastics come into question. In particular, the first and/or the second plastic material can comprise a thermoplastic. By the thermoplastic, a welding of the holding plate, in particular the base plate, with the bag wall is possible.

In particular the second plastic material can be a thermoplastic elastomer. The applicant of the present invention has found that in this case, one can surprisingly obtain a particularly strong connection between the holding plate and the bag wall. The thermoplastic elastomer can be, for example, a thermoplastic polyamide elastomer (TPA), thermoplastic urethane elastomer (TPU), or thermoplastic styrene elastomer (TPS).

The first plastic material can comprise, for example, polypropylene, polystyrene, acrylonitrile-butadiene-styrene (ABS) and/or polyamide.

As an alternative or in addition, the second plastic material can have a higher melt flow index than the first plastic material, in particular wherein the second plastic material comprises a melt flow index higher by a factor 5 to 40, in particular 10 to 30, in particular 10 to 20, than in the first plastic material. This is in particular true if the first as well as the second plastic materials are thermoplastics.

The melt flow index, also referred to as melt mass-flow rate, serves to characterize the flow properties of a thermoplastic at predetermined pressure and temperature conditions.

In other words, the melt flow index is a measure for the flow property of a plastic melt.

The first plastic material can have a melt flow index of 50 g/10 min to 200 g/10 min, in particular of 50 g/10 min to 150 g/10 min. The second plastic material can have a melt flow index of 1000 g/10 min to 2000 g/10 min, in particular of 1000 g/10 min to 1500 g/10 min. By this, the second plastic material has a lower viscosity than the first plastic material and can permit a stronger connection between the base plate and the bag wall.

As an alternative or in addition, the second plastic material can have a lower melting temperature or a lower melting point than the first plastic material. By this, the energy required for the connection between the base plate and the bag wall can be reduced.

The connecting element can be embodied to be continuous or interrupted, in particular linear. The connecting element can in particular be embodied as an elevation on the base plate.

The connecting element can be arranged to partially or completely surround the passage opening. For example, the connecting element can be arranged rotationally symmetrically with respect to a perpendicular axis of the passage opening of the base plate. The connecting element can also be arranged axially and/or centrically symmetric with respect to the passage opening.

The base plate can comprise an indentation, wherein the connecting element is partially or completely arranged in the indentation. The indentation can be embodied in the form of a groove, in particular an oblong, circular or oval groove, or in the form of a blind hole.

The connecting element can be arranged on the surface of the base plate provided for the connection with the bag wall. In particular, the connecting element can be arranged in one or several regions of the surface of the base plate provided for the connection with the bag wall which, in the operation of the vacuum cleaner and/or during the removal of the filled vacuum cleaner filter bag from the vacuum cleaner, is subjected to the highest stress, in particular by tensile loads.

The base plate can moreover comprise one or several energy directors for ultrasonic welding on the side to be connected to the bag wall. The directors or energy directors can be acute and/or sharp-edged elevations on the surface of the base plate provided for welding with the bag wall by which the ultrasonic energy can be concentrated. The welding of such energy directors is usually successful at lower ultrasonic energies than with smooth surfaces.

The connecting element can be in particular embodied in the form of one or several energy directors.

The region of the base plate in which the connecting element is arranged can be partially or completely limited or surrounded by energy directors. For example, two rows of energy directors can be arranged to surround the passage opening at different distances, where the connecting element is arranged partially or completely between the two rows of energy directors.

The holding plate can moreover comprise a sealing lip for the passage opening in the holding plate, in particular in the base plate, in particular wherein the sealing lip consists of the same material as the connecting element. In other words, the sealing lip can consist of the second plastic material or comprise the second plastic material.

The holding plate can in particular be an injection-molded part, in particular a molded part made by two-component injection molding. The holding plate can be a molded part made by two-component injection, wherein the connecting element is injected to the base plate. An optionally existing sealing lip can be injected to the base plate simultaneously with the connecting element. In this case, the sealing lip and the connecting element can in particular consist of a TPE.

The holding plate can moreover comprise a closure flap. By this, the passage opening in the bag wall and the base plate can be closed when the vacuum cleaner is not operated, i.e. when the vacuum cleaner is switched off.

The invention moreover provides a vacuum cleaner filter bag with a holding plate described above. In other words, the invention provides a vacuum cleaner filter bag with a bag wall and a holding plate, the holding plate comprising a base plate of a first plastic material, wherein the base plate comprises a passage opening, and a connecting element of a second plastic material connected to the base plate by a material bond for connecting the base plate with the bag wall by a material bond, in particular by means of ultrasonic welding, wherein the connecting element is arranged on the side of the base plate connected to the bag wall.

In particular, the bag wall can be connected to the holding plate, in particular to the base plate, by a material bond. The base plate can be connected to the bag wall by a material bond in particular via the connecting element.

A connection by a material bond is a connection in which the elements to be connected are held together by atomic or molecular forces. A connection by a material bond can in particular be a non-releasable connection, in particular a connection that cannot be released in a nondestructive manner.

The vacuum cleaner filter bag can be a flat bag. As an alternative, the vacuum cleaner filter bag can also be a block bottom bag. The vacuum cleaner filter bag can in particular be a disposable vacuum cleaner bag.

The vacuum cleaner filter bag, in particular the bag wall, can comprise a front and a back side which are connected to each other by a surrounding weld seam. The front side and the back side can be rectangular, square or circular. The front side and back side can comprise at least one non-woven layer, that means a layer of a non-woven material.

The holding plate and/or the bag wall of the vacuum cleaner filter bag can comprise one or several ones of the above-described features.

The invention moreover provides a method for connecting a holding plate with a bag wall, comprising the steps of: providing an above-described holding plate, providing a bag wall and connecting the holding plate with the bag wall by means of ultrasonic welding.

The bag wall and/or the holding plate can in particular comprise one or several ones of the above-described features.

The connection by means of ultrasonic welding can include the introduction of ultrasonic energy into the holding plate by means of a sonotrode. In the process, the sonotrode can be contacted with the holding plate, in particular with the base plate of the holding plate. Typically, 50 to 400 Joules of ultrasonic energy are introduced in 0.1 to 0.5 seconds.

In case of ultrasonic welding, the connecting element can be a welding element, in particular wherein the base plate is welded with the bag wall, in particular via the welding element.

By the connecting element, the bag wall can be firmly connected to the base plate with only little ultrasonic energy.

The invention moreover provides a method for the manufacture of an above-described holding plate, comprising the steps of: providing a mold for injection molding an above-described holding plate, in a first injection molding step, injection molding the base plate, and in a second injection molding step, injecting the connecting element to the base plate.

Simultaneously with the connecting element, a sealing lip can also be injected to the base plate. Simultaneously with the base plate, a closure flap, in particular connected to the base plate, can also be formed.

BRIEF DESCRIPTION OF THE DRAWINGS

Below, the invention will be described more in detail with reference to examples and the figures. In the drawings.

DETAILED DESCRIPTION

Figure 1:
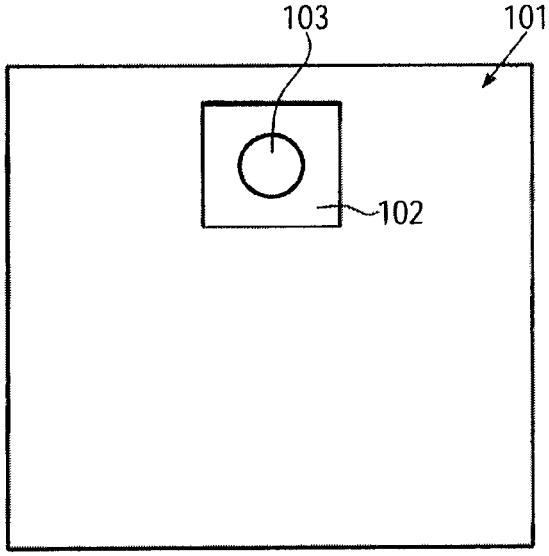
FIG. 1 schematically shows the design of an exemplary vacuum cleaner filter bag.

FIG. 1 shows the schematic design of an exemplary vacuum cleaner filter bag. The filter bag comprises a bag wall 101, a holding plate with a base plate 102, and an admission port through which the air to be filtered flows into the filter bag. The admission port is here formed by a passage opening 103 in the base plate 102 and a passage opening in the bag wall 101 aligned with it. The holding plate 102 serves to fix the vacuum cleaner filter bag in a chamber of a vacuum cleaner.

The bag wall 101 comprises at least one non-woven layer, for example of a melt-spun fine fibrous non-woven (melt-blown non-woven).

The holding plate comprises a base plate 102 of a first plastic material and a connecting element of a second plastic material connected to the base plate 102 by a material bond, wherein the connecting element is arranged on the side of the base plate 102 connected to the bag wall. The base plate 102 is connected to the bag wall 101 by means of ultrasonic welding by a material bond.

The first plastic material of the exemplary holding plate 102 comprises polypropylene with a melt flow index of 100 g/10 min, and the second plastic material comprises polypropylene with a melt flow index of 1000 g/10 min.

The melt flow index is defined according to ISO 1133 and is measured by means of a capillary rheometer. The melt flow index indicates the mass of thermoplastic melt pressed through a predetermined nozzle within 10 minutes under a predetermined pressure application.

As second plastic material, a thermoplastic elastomer (TPE) can also be used. Block copolymers as well as elastomer alloys can be used.

Figure 2:
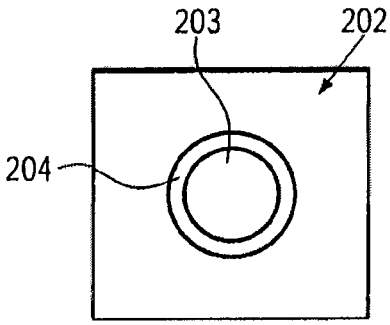
FIG. 2 shows the schematic design of an exemplary holding plate in a plan view.

In FIG. 2, a plan view onto a front side of an exemplary holding plate with a base plate 202 is shown. The front side here corresponds to the side of the holding plate or base plate 202 not provided for the connection with the bag wall. The base plate 202 comprises a passage opening 203. Through the passage opening 203, a connecting piece of the vacuum cleaner can be guided into or to the filter bag. Thereby, the air to be filtered can be introduced into the filter bag. A sealing lip 204 is provided to prevent dust from escaping between the connecting piece and the bag wall of the vacuum cleaner filter bag.

The front side of the base plate 202 can also comprise an attachment face for a sonotrode and/or positioning elements for positioning a sonotrode. By this, a more precise positioning of the sonotrode for ultrasonic welding can be achieved.

The base plate 202 comprises a first plastic material comprising a thermoplastic, for example polypropylene. The sealing lip 204 comprises a thermoplastic elastomer, for example based on polypropylene. The sealing lip 204 is here made of a softer plastic material than the base plate 202.

The exemplary base plate 202 is here designed as a square plate. However, very diverse geometries or shapes are conceivable for the base plate 202.

Figure 3:
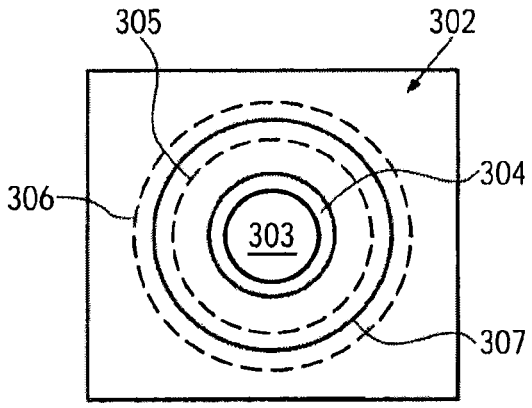
FIG. 3 shows a plan view onto the side of an exemplary holding plate to be connected with the bag wall.

FIG. 3 shows a plan view onto the side of an exemplary holding plate to be connected with the bag wall. The exemplary holding plate comprises a base plate 302 with a passage opening 303 and a sealing lip 304 surrounding the passage opening 303. Moreover, FIG. 3 shows two rows of energy directors 305 and 306 for welding the base plate 302 to the bag wall by ultrasonic welding. Moreover, FIG. 3 shows a connecting element 307 which is arranged between the two rows of energy directors 305, 306.

The connecting element 307 comprises the same plastic material as the sealing lip 304 and was simultaneously injected to the base plate 302 with a two-component injection molding process.

In particular, the exemplary holding plate is formed with a two-component injection molding process, wherein in a first injection molding step, the base plate 302 is injection molded, and in a second injection molding step, the connecting element 307 is injected to the base plate 302 simultaneously with the sealing lip 304 for the passage opening 303.

The base plate 302 comprises an above-described first plastic material, and the connecting element 307 an above-described second plastic material.

The first plastic material comprises polypropylene, and the second plastic material corresponds to a thermoplastic elastomer. As an alternative or in addition, the second plastic material can also have a lower melting temperature than the first plastic material. In this manner, a plastic material can be used for the base plate 302 which usually cannot be well connected to the material of the bag wall, for example polyamide.

Figure 4:
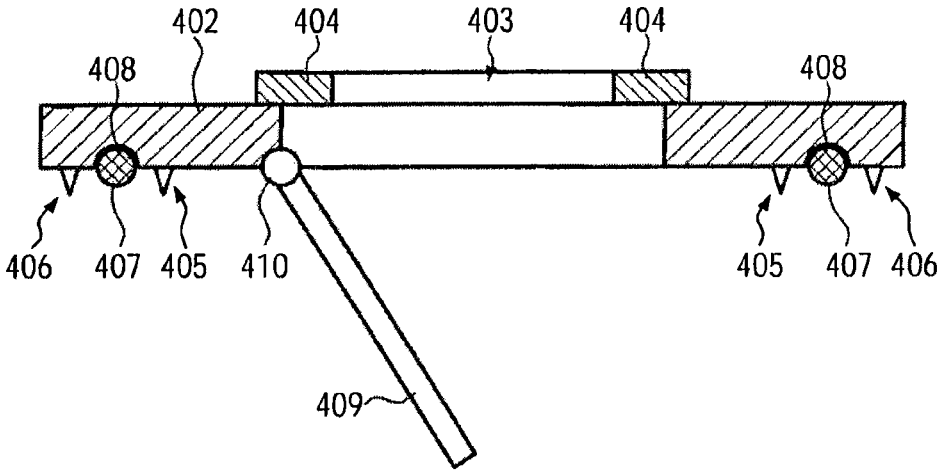
FIG. 4 shows a cross-section through an exemplary holding plate.

FIG. 4 shows a cross-section through an exemplary holding plate with a base plate 402, comprising a passage opening 403, a sealing lip 404 surrounding the passage opening 403, and a connecting element 407 arranged at the base plate 402. The connecting element 407 is arranged to be surrounded by energy directors 405 and 406, respectively. The holding plate moreover comprises a closure flap 409 which is connected to the base plate 402 of the holding plate via an integral hinge 410. By the closure flap 409, the passage opening 403 can be closed when the vacuum cleaner is not in operation.

The closure flap 409 can be injection molded simultaneously with the base plate 402 in a first injection molding step. In particular, the closure flap 409 and the integral hinge 410 can be embodied as one element. In particular, the closure flap 409 and the integral hinge 410 can comprise the above-described first plastic material or consist of it.

In the exemplary embodiment of FIG. 4, the connecting element 407 is partially arranged in an indentation 408 of the base plate 402 and projects beyond the surface of the base plate 402. The connecting element can also project beyond the surface of the base plate 402 flush with the energy directors 405, 406.

The connecting element 407 can also be arranged completely in the indentation 408 of the base plate 402. In this case, the connecting element 407 can be flush with the surface of the base plate 402.

The connecting element 407 is arranged to completely surround the passage opening 403. As an alternative, the connecting element 407 can also be arranged only in the region of the integral hinge 410.

In FIG. 4, energy directors 405, 406 and the connecting element 407 are shown separate from each other. The energy directors 405, 406, however, can also comprise the connecting element 407. In particular, the connecting element 407 can be arranged in the region of the tips of the energy directors 405, 406. By this, the energy required for the connection of the base plate 402 with the bag wall can be further reduced.

By the connecting element 407, the base plate 402 can be connected to the bag wall by means of ultrasonic welding with only little welding energy. By this, the risk of damages to sensitive regions of the holding plate, for example the closure flap 409 and its integral hinge 410 or the sealing lip 404, is reduced. Simultaneously, the pull-off strength, that means the force that is necessary to release the base plate 402 from the bag wall connected to it, is clearly higher, for example by about a factor 2, than without the connecting element 407.

It will be understood that features mentioned in the above described embodiments are not restricted to these special combinations and are also possible in any other combinations. It will be furthermore understood that in the figures, neither the shown vacuum cleaner filter bag nor the elements of the holding plate are represented in realistic dimensions. Moreover, the geometries or shapes of the shown elements are not restricted to the shown examples.

The invention claimed is:

1. A holding plate for a vacuum cleaner filter bag with a bag wall, the holding plate comprising:

a base plate comprising a first plastic material, wherein the base plate comprises a passage opening, and one or several energy directors for ultrasonic welding on the side to be connected to the bag wall;

a connecting element comprising a second plastic material connected to the base plate by a material bond, the second plastic material being different than the first plastic material, the second plastic material comprising an injectable material so that the connecting element is injected to the base plate, the connecting element for connecting the base plate to the bag wall by a material bond;

wherein the connecting element is arranged on a side of the base plate to be connected to the bag wall so that the connecting element is positioned between the base plate and the bag wall when the holding plate is connected to the bag wall, wherein the holding plate is an injection-molded part.

2. The holding plate according to claim 1, wherein the first or the second plastic material comprises a thermoplastic.

3. The holding plate according to claim 1, wherein the second plastic material has a higher melt flow index than the first plastic material.

4. The holding plate according to claim 1, wherein the second plastic material has a lower melting temperature than the first plastic material.

5. The holding plate according to claim 1, wherein the connecting element is continuous or interrupted.

6. The holding plate according to claim 1, wherein the connecting element is arranged to partially or completely surround the passage opening.

7. The holding plate according to claim 1, wherein the base plate comprises an indentation and the connecting element is partially or completely arranged in the indentation.

8. The holding plate according to claim 1, wherein the connecting element is arranged in a region of the base plate which is at least partially or completely restricted or surrounded by energy directors.

9. The holding plate according to claim 1, comprising a sealing lip for the passage opening in the holding plate.

10. A vacuum cleaner filter bag with a holding plate according to claim 1.

11. The vacuum cleaner filter bag according to claim 10, wherein the bag wall is connected with the base plate of the holding plate, by a material bond.

12. The holding plate according to claim 1, wherein the material bond connecting the base plate to the bag wall comprises an ultrasonic weld.

13. The holding plate according to claim 1, wherein the second plastic material has a melt flow index higher than the first plastic material by a factor of 10 to 20.

14. The holding plate according to claim 1, wherein the connecting element is linear.

15. The holding plate according to claim 9, wherein the sealing lip consists of the same material as the connecting element.

16. The holding plate according to claim 1, wherein the holding plate comprises a molded part made by two-component injection molding.

17. The holding plate according to claim 1, wherein the one of several energy directors comprise one or several elevations on the surface of the base plate extending outward from the surface of the base plate, the one or several energy directors positioned between the base plate and the bag wall when the holding plate is connected to the bag wall.

* * * * *